US008215861B2

(12) United States Patent
Gueret

(10) Patent No.: US 8,215,861 B2
(45) Date of Patent: Jul. 10, 2012

(54) PACKAGING AND APPLICATOR DEVICE

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 1555 days.

(21) Appl. No.: 11/703,241

(22) Filed: Feb. 7, 2007

(65) Prior Publication Data

US 2007/0189841 A1 Aug. 16, 2007

Related U.S. Application Data

(60) Provisional application No. 60/778,094, filed on Mar. 2, 2006.

(30) Foreign Application Priority Data

Feb. 15, 2006 (FR) ..... 06 01451

(51) Int. Cl.
*B05C 11/00* (2006.01)

(52) U.S. Cl. ..... 401/266

(58) Field of Classification Search ..... 401/261–266
See application file for complete search history.

(56) References Cited

U.S. PATENT DOCUMENTS

| | | | | |
|---|---|---|---|---|
| 3,133,308 | A | 5/1964 | Claypool | |
| 3,618,825 | A | 11/1971 | Clarke | |
| 3,807,881 | A | 4/1974 | Seidler | |
| 5,018,894 | A | 5/1991 | Goncalves | |
| 5,120,148 | A * | 6/1992 | Waters et al. | 401/264 |
| 5,131,773 | A | 7/1992 | Gueret | |
| 5,199,808 | A | 4/1993 | Gueret | |
| 5,727,892 | A | 3/1998 | Baudin | |
| 6,309,128 | B1 * | 10/2001 | Griebel et al. | 401/264 |
| 6,332,730 | B1 * | 12/2001 | Taghavi-Khanghah | 401/264 |
| 6,676,321 | B2 | 1/2004 | Gueret | |
| 6,715,951 | B2 | 4/2004 | Gueret | |
| 6,745,781 | B2 | 6/2004 | Gueret | |
| 6,773,187 | B2 | 8/2004 | Gueret | |
| 6,953,297 | B2 * | 10/2005 | Dobbs et al. | 401/188 R |
| 7,344,328 | B2 * | 3/2008 | McAuley | 401/264 |

(Continued)

FOREIGN PATENT DOCUMENTS

EP 0 245 983 A2 11/1987

(Continued)

OTHER PUBLICATIONS

Chinese Office Action issued in Chinese Patent Application No. 2007-10005165.8 on Nov. 20, 2009 (with translation).

*Primary Examiner* — Huyen Le
(74) *Attorney, Agent, or Firm* — Oliff & Berridge, PLC

(57) ABSTRACT

The present invention relates to a packaging and applicator device, comprising:

a reservoir containing at least one composition for application;

a support that is secured to the reservoir during application and/or when the device is in a closed configuration; and a non-porous membrane that is carried by the support, that has at least one dispenser orifice passing therethrough for dispensing the composition, and that is externally covered, at least in part, by flocking;

the membrane co-operating with the support and/or with the reservoir to define an inside space containing the composition;

the membrane being flexible and/or mounted on the support and/or on the reservoir in such a manner as to present the possibility of being deformed and/or of being displaced relative to the support and/or to the reservoir, resulting in a reduction in the volume of the inside space of at least 0.1 mL.

39 Claims, 16 Drawing Sheets

U.S. PATENT DOCUMENTS

| | | | |
|---|---|---|---|
| 2002/0003983 | A1 | 1/2002 | Gueret |
| 2003/0129016 | A1 | 7/2003 | Gueret |
| 2005/0141951 | A1 | 6/2005 | Gueret |

FOREIGN PATENT DOCUMENTS

| | | | |
|---|---|---|---|
| EP | 1 151 693 | A1 | 11/2001 |
| EP | 1 524 199 | A1 | 4/2005 |
| GB | 890 348 | A | 2/1962 |
| GB | 1 170 341 | A | 11/1969 |
| GB | 2 232 074 | A | 12/1990 |
| JP | A 05-028226 | | 2/1993 |
| WO | WO 02/096571 | A2 | 12/2002 |

* cited by examiner

PACKAGING AND APPLICATOR DEVICE

This non provisional application claims the benefit of French Application No. 06 01451 filed on Feb. 15, 2006 and U.S. Provisional Application No. 60/778,094 filed on Mar. 2, 2006.

The present invention relates to packaging and applicator devices for applying at least one cosmetic or skin product, e.g. makeup, or a care product for the body, the face, or the hair.

BACKGROUND

Numerous applicators comprising a porous applicator element such as a foam are known, in particular from U.S. publications Nos. 6,773,187, 6,715,951 and 2003/0129016 A1.

Even though they are generally comfortable to use, such applicator elements may nevertheless present a certain number of drawbacks.

Firstly, some of the composition potentially may remain in the pores of the foam without being able to be applied, thereby resulting in a loss of composition, in particular when the foam is cleaned several time during the lifetime of the device.

In addition, the applicator element may turn out to be difficult to make with a foam that is very compressible so as to impart comfort in use, while nevertheless being strong enough to be mounted on the device.

Finally, during use, the foam may generate an abrasive sensation that might not be desirable.

In addition, packaging and applicator devices are known in which the applicator surface is defined by a non-porous membrane having one or more orifices passing therethrough. Such devices are generally used for applying a deodorant or a massage composition for which the application conditions are less critical than for makeup which often requires a relatively uniform deposit without any visible application defects.

U.S. Pat. Nos. 5,727,892, 5,199,808, and 3,618,825 describe devices of that type.

In U.S. Pat. Nos. 3,618,825 and 5,727,892, the membrane that is flexible rests on a rigid part and can form a valve that opens under the pressure of the composition.

In U.S. Pat. No. 5,199,808, the membrane rests on a block of foam. It is mentioned that it is possible, in a variant, to make the applicator element out of optionally-flocked foam.

Finally, applicators are known that are intended more particularly for applying lipstick. Such applicator devices are described in particular in U.S. Pat. Nos. 3,807,881, 5,131,773, and 6,745,781. In the last of those documents, the applicator surface is defined by a flocked grid that can be made of a flexible material so as to make it easier to put it into place on a support part. Such a grid is not designed to be displaced relative to the support part during application.

Finally, applicators for applying a stain remover are known that include fabric with loops resting on a rigid support, for example, as disclosed in JP 5-28226/1993.

SUMMARY

There exists a need to improve packaging and applicator devices for applying a composition to the skin or the hair in particular.

Examplary embodiments of the invention provide a packaging and applicator device, comprising:

- a reservoir containing at least one composition for application;
- a support that is secured to the reservoir during application and/or when the device is in a closed configuration; and
- a non-porous membrane that is carried by the support, that has at least one dispenser orifice passing therethrough for dispensing the composition, and that is externally covered, at least in part, by flocking, the membrane co-operating with the support and/or with the reservoir to define an inside space that is suitable for containing composition to be dispensed.

The membrane may be flexible and/or mounted on the support and/or on the reservoir in such a manner as to present the possibility of being deformed and/or of being displaced relative to the support and/or to the reservoir, resulting in a reduction in the volume of the inside space of at least 0.1 milliliters (mL).

Such variation in the volume of the inside space may make it possible to increase pressure a little, thereby making it easier for the composition to escape.

This may make it possible to make the dispenser orifice(s) relatively small, so as to avoid composition suddenly escaping in the event of the device being turned upsidedown, while enabling a sufficient quantity of composition to reach the applicator surface ready for use.

The reduction in volume may be at least 0.5 mL, better at least 1 mL, still better at least 1.5 mL, 2 mL, or 3 mL.

The reduction in volume may be as a result of deformation of the membrane that may be flexible, or as a result of displacement of the membrane when said membrane is rigid.

In exemplary embodiments, the membrane may be rigid and may be displaced in translation. In various exemplary embodiments, the membrane may be flexible and may optionally be displaceable in translation.

The membrane may be made in a material that is different from an open cell foam, not comprising pores interconnected in all directions.

The device may comprise at least one element limiting the deformation of the membrane at use. This element may be fixed onto the reservoir or may be monolithically molded with the reservoir.

The element may be flexible and may bend during application of the composition.

This element may be for example in the form of a fin in contact with an inside face of the membrane.

Examplary embodiments of the invention provide a packaging and applicator device, comprising:

- a reservoir containing at least one composition for application;
- a support that is secured to the reservoir during application and/or when the device is in a closed configuration; and
- a non-porous membrane that is carried by the support, that has at least one dispenser orifice passing therethrough for dispensing the composition, and that is externally covered, at least in part, by flocking; the membrane being flexible and mounted on the support in such a manner as to present, for at least a portion of the membrane, the possibility of being deformed and/or of being displaced relative to the support and/or to the reservoir over a distance that enables said membrane portion to adapt to the region on which the application is taking place, e.g. a distance of at least 1.5 millimeters (mm), and better of at least 3 mm.

The support may form part of the reservoir, being defined by the neck of said reservoir, for example, and/or it may serve to fasten the membrane on said reservoir. The support may be molded with the membrane, the support and the membrane being made of different thermoplastic materials, for example.

The support may be a part that is fitted on the reservoir, or that is molded as a single piece with said reservoir.

A device according to the invention may make it possible to remedy all or part of the above-mentioned drawbacks of foam applicator elements, and it may be found to be comfortable in use because of the ability of the membrane to deform and/or move while it is in use, e.g. in contact with the skin.

In an embodiment of the invention, the membrane is molded with at least one duct communicating with the dispenser orifice(s). Such a duct may make it possible to channel the composition coming from the reservoir to the dispenser orifice(s), and may make it possible to avoid composition accumulating below the membrane in a location remote from the dispenser orifice(s). This may make it possible to reduce loss of composition and/or the time required for the composition to reach the applicator surface. This may also make it easier for the composition to flow through the dispenser orifice(s) when an increase in pressure is created below the membrane.

Furthermore, the presence of such a duct may make it possible to create a headloss, if necessary, between the reservoir and the dispenser orifice(s), and may thus make it possible to adapt the rate at which the composition is dispensed as a function of the nature of said composition and/or as a function of the characteristics of the region to be treated.

Finally, the presence of the above-mentioned duct may make it possible to provide, below the membrane, a resilient return member that is protected from contact with the composition, e.g. a metal spring or a foam, or even a cushion of air. The membrane may also be elastically deformable, returning under its own elasticity to its initial shape.

In an embodiment of the invention, the above-mentioned duct may slide in or over a chimney of the device, which chimney may be made with the above-mentioned support, for example. Such sliding may enable the membrane to be depressed relatively easily, while maintaining substantially leaktight communication between the chimney and the duct.

When the composition presents a certain color, the membrane may advantageously made in substantially the same color. The flocking may thus be white, for example. When the flocking is wet with the composition, this may make it possible to improve the appearance of the membrane, since a flocked white membrane might look dirty with a colored composition. When it is impregnated by the composition, the flocking may cause the color of the membrane to appear. The membrane may also be transparent or translucent. The flocking may be colored and the membrane white.

In an embodiment of the invention, the membrane may be molded with a peripheral skirt, said skirt possibly being of height that may be greater than or equal to 10 mm, for example.

By way of example, such a peripheral skirt may serve to fasten the membrane on the device, in particular to fasten it on the support.

When the membrane may be displaced relative to the support, the peripheral skirt may also guide the membrane in its displacement relative to the support.

The peripheral skirt may be made in such a manner as to enable the entire membrane to be depressed relative to the support, and, for example, it may be made with an elastically-deformable portion, e.g. a portion in the shape of bellows, or it may include resilient tabs.

The peripheral skirt may optionally rest against the bottom of a housing of the support and/or of the reservoir receiving the membrane.

The membrane may be fastened in various ways on the support, e.g. it may be snap-fastened thereon, force fitted, held by a folded-back edge of the support or by an add-on fastener part, or even fastened by adhesive, heat sealing, deforming the membrane or the support while hot, or stamping the support.

The reservoir may have a flexible or rigid wall.

The reservoir may be fitted with a pump or with a piston and with an advance mechanism for advancing said piston.

The reservoir may also be provided with a valve, and the composition to be dispensed may be contained in a space that is pressurized, e.g. by means of a compressed or liquefied propellant gas.

The membrane may present an outer surface that is concave or convex. At least one dispenser orifice may be situated in a recess of the membrane or at the top of a boss of said membrane.

The membrane may present, for example in its flocked portion, a shape that may generally be circularly symmetrical.

By way of example, the above-mentioned deformation and/or displacement distance of the membrane on application may, for example, be at least 5 mm, e.g. lying in the range 5 mm to 15 mm.

The membrane may be made of a compressible material, e.g. an elastomer. The membrane may also be made of a relatively rigid material, for example when it can be displaced relative to the support and/or to the reservoir.

The composition contained in the reservoir may be permanently in communication with the dispenser orifice(s), without any flow reducer between the reservoir and the membrane, where appropriate. In a variant, at least one interrupter system for interrupting communication between the reservoir and the dispenser orifice(s) may be provided so as to avoid composition being accidentally dispensed while the device is not in use, for example while the device is being transported.

The composition may present a viscosity that is sufficiently low to make it possible to load the flocked surface by capillarity, e.g. after turning the device upsidedown in a head-down position.

In an embodiment of the invention, the section occupied by the dispenser orifice(s) may be less than 75% of the area of the membrane that is covered by the flocking, and better less than 30%.

The section of the dispenser orifice(s) may be selected as a function of the viscosity of the composition.

By way of example, in cross-section, the dispenser orifice (s) may present a greatest dimension that is less than or equal to 2 mm, e.g. lying in the range 0.4 mm to 1.8 mm, and better in the range 0.8 mm to 1.5 mm.

The section of the dispenser orifice(s) may optionally be circular, so as to increase the quantity of composition that is retained by capillarity in the orifices.

The dispenser orifice(s) may be open permanently, or closed at rest, opening under the pressure of the composition, the pressure resulting from the user acting on a wall of the reservoir, or from the presence of a piston, or from some other means for putting the composition under pressure, e.g. a compressed or liquefied gas.

The support may be arranged to close the reservoir.

The surface covered by the flocking may have an area that is greater than or equal to 175 square millimeters ($mm^2$), so as to be suitable for application to the body or the face.

In particular in its region covered by the flocking, the membrane may present a thickness lying in the range 0.2 mm to 5 mm.

By way of example, the length of the flocking bristles lies in the range 0.2 mm to 2.5 mm, e.g. being about 1.3 mm. The diameter of the bristles may vary in the range 1 denier to 35 denier, for example. The flocking may be made in such a manner as to obtain the desired flow of composition as a function of the nature of said composition.

Thus, the membrane may be flocked with bristles of various kinds and/or thicknesses and/or lengths so as to act on the capillarity, the smoothness, the flowrate, or the distribution of composition on the applicator surface. Where appropriate, some bristles may present abrasive properties, e.g. being more rigid.

The membrane and/or the bristles of the flocking may be magnetic and/or treated with antibacterial agents.

The membrane and/or the flocking could be made in such a manner as to conduct electricity.

Where appropriate, the membrane may include at least one portion in relief for massaging or treating the hair.

The dispenser orifice(s) may optionally be located at the center of the membrane, which may include a dispenser orifice that may optionally be situated on the axis of the device.

In an embodiment of the invention, the support may be fitted on the reservoir, and the membrane may include a rim that is fastened by clamping between the reservoir and the support. The rim may include a groove or an annular lip that co-operates with a corresponding lip or groove of the support or of the reservoir, thereby further improving sealing.

In an exemplary embodiment, the membrane may be fitted at least partially on a bearing part which may be the support above and which may be made of a material more rigid than the material of the membrane.

The bearing part may include at least one fin that substantially matches the shape of the inside face of the membrane.

The bearing part may include several fins whose distal portions may be free or connected together by an annular portion. The annular portion may define a passage for the composition.

The device may include a closure cap that covers the membrane in the closed configuration of the device. The cap may include a lip that bears against the membrane along a line surrounding the dispenser orifice(s).

The cap may co-operate with either the support or the reservoir to compress the membrane between them along a line surrounding the dispenser orifice(s), thereby making it possible to obtain sealing along said line.

The cap may present an inner surface that substantially matches the outer shape of the membrane, thereby making it possible to improve sealing and/or reduce the risk of composition accumulating on the flocking when the device is not in use. The cap may include a hole enabling at least one flocked portion of the membrane to be in contact with the air in the closed configuration of the device, so as to enable said flocked portion to dry. The cap may alternatively be fastened on the support and/or on the reservoir in completely leaktight manner.

The device may be provided with a vibration generator which may be removable or permanent, and which may be operated by the user.

By way of example, the optional presence of vibration may make it possible for the user to modify, as desired, the quantity of composition deposited on the keratinous materials, so as to change the color of a foundation, for example. Where appropriate, the vibration generator may be of variable frequency, the frequency being adjusted by the user as a function of the desired application conditions.

The invention also provides a method of treating keratinous materials, in particular a method of applying makeup, in which the composition is applied by means of a device as defined above.

Composition may be applied in a layer that is of substantially constant thickness.

The applicator surface may slide easily over the skin and may take away little impurity from its surface.

Since the membrane is non-porous, the risk of dirt accumulating may be reduced.

Exemplary embodiments of the invention provide a packaging and applicator device, comprising:

- a reservoir containing at least one composition for application;
- a support that is secured to the reservoir during application and/or when the device is in a closed configuration; and
- a non-porous membrane that is carried by the support, that has at least one dispenser orifice passing therethrough for dispensing the composition, and that is externally covered, at least in part, by flocking, the membrane co-operating with the support and/or with the reservoir to define an inside space containing the composition, the membrane being flexible and/or mounted on the reservoir in such a manner as to present the possibility of being deformed and/or of being displaced relative to the support and/or to the reservoir, resulting in a reduction in the volume of the inside space, the flocked region of the membrane extending transversally to the longitudinal axis of the device over a distance that is greater than or equal to 15 mm. Such a flocked membrane may be particularly suited to treating large areas of the body or of the face.

Exemplary embodiments of the invention provide a packaging and applicator device, comprising:

- a reservoir containing at least one composition for application;
- a support that is secured to the reservoir during application and/or when the device is in a closed configuration;
- a non-porous membrane that is carried by the support, that has at least one dispenser orifice passing therethrough for dispensing the composition, and that is externally covered, at least in part, by flocking up to a peripheral portion, the membrane being mounted on the support and/or on the reservoir in such a manner that the peripheral portion presents the possibility of being deformed and/or of being displaced relative to the support and/or to the reservoir.

By way of example, the peripheral portion may be defined by a tubular skirt. The outline of the flocked peripheral portion may be circular, for example.

BRIEF DESCRIPTION OF THE DRAWINGS

The invention can be better understood on reading the following detailed description of non-limiting embodiments thereof, and on examining the accompanying drawings, in which.

MORE DETAILED DESCRIPTION

Figure 1:
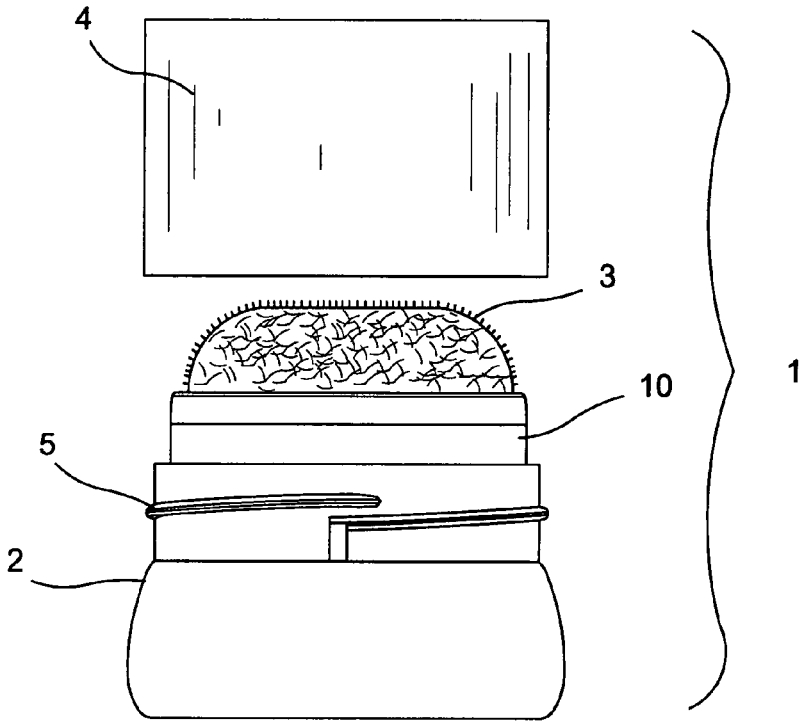
FIG. 1 is an elevation view of an example of a packaging and applicator device constituting an embodiment of the invention.
Figure 2:
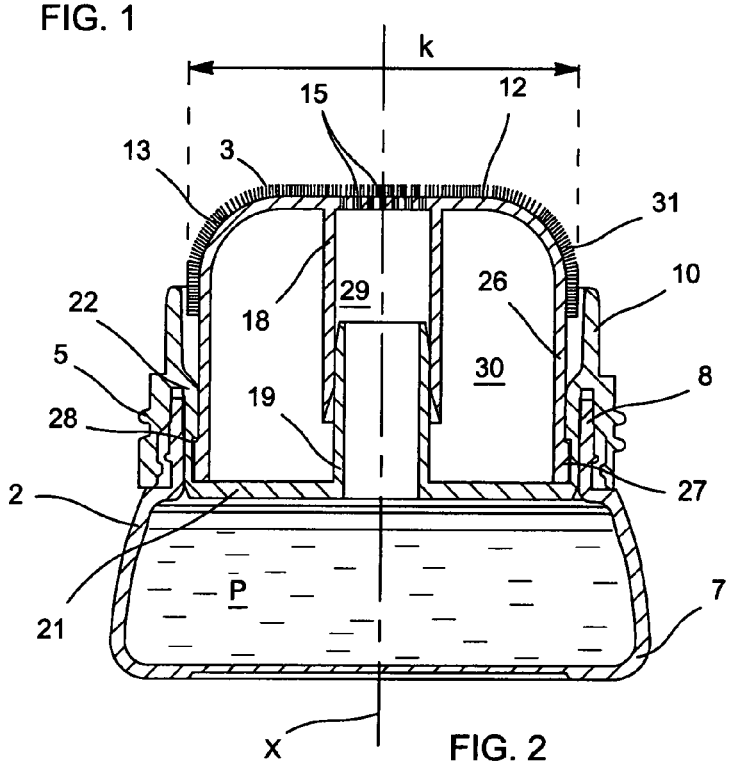
FIG. 2 is a fragmentary axial section of the FIG. 1 device.

The device 1 shown in FIGS. 1 and 2 comprises a reservoir 2 containing at least one composition P, e.g. a cosmetic, in particular makeup or a care product for the skin or the hair, and a dispenser head defining an applicator surface 3 for applying the composition P to keratinous materials.

By way of example, the composition P is a blusher, a foundation, a lipstick, a sun-screen, a care product, a hair treatment, a slimming agent, or a self-tanning agent.

The reservoir 2 comprises a body 7 provided with a neck 8 on which there is fastened a support 10 serving to hold a membrane 12 that is externally covered, at least in part, by flocking 13 defining the applicator surface 3.

The device 1 also comprises a closure cap 4, which, in the embodiment under consideration, is suitable for being screw-fastened on a thread 5 of the support 10.

The membrane 12 is made of a non-porous material, e.g. selected from: elastomers, in particular thermoplastic elastomers; nitrile- or silicone-based elastomers; polyurethane; and ethylene-propylene terpolymer rubber (EPDM).

From amongst thermoplastic elastomers, mention can be made of the following elastomers: polyethylene (PE); polystyrene (PS); polyethylene terephthalate (PET); polyurethane (PU); polyvinyl chloride (PVC); and ethyl vinyl acetate (EVA). Suitable elastomers are known under the trade names HYTREL, PEBAX (polyether block amide), and SANTOPRENE, amongst others.

In the embodiment under consideration, the flexibility of the membrane 12 enables it to deform during application in contact with the surface to be treated.

The membrane 12 is advantageously washable, optionally being removable so as to enable the user to remove it from the reservoir so as to wash it, and then put it back into place.

Orifices 15 pass through the membrane 12 so as to enable the composition P to reach the applicator surface 3.

By way of example, the orifices 15 are made by molding with the membrane 12, but they can also be made after said membrane has been manufactured, by piercing.

The bottom ends of the orifices 15 open out into a duct 18 of the membrane 12 that is engaged on a chimney 19 of the support 10, of longitudinal axis X.

By way of example, the duct 18 is made by being molded together with the remainder of the membrane 12.

The duct 18 presents a cross-section that is optionally circular.

The base of the chimney 19 is connected to a transverse wall 21 of the support 10 that is extended by a peripheral portion 22 serving to fasten the support 10 on the neck 8, e.g. by snap-fastening.

The presence of the duct 18 is advantageous in that it makes it possible to reduce, and even avoid, composition penetrating into the annular chamber 30 defined around the duct 18 and the chimney 19, inside the device.

Figure 3:
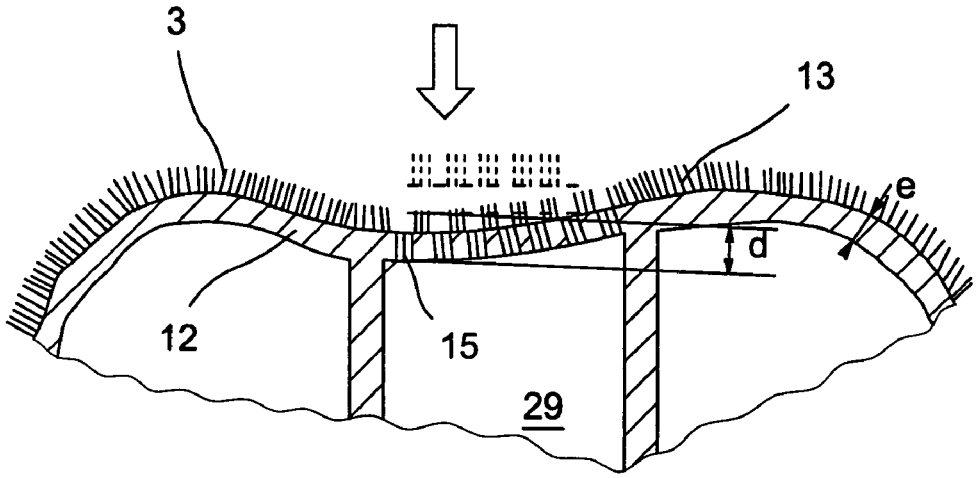
FIG. 3 is a detail of FIG. 2, showing the possibility of deforming the membrane.

The extent to which the membrane 12 deforms depends on the force exerted thereon. In the embodiment under consideration, the membrane 12 may be deformed through a distance d of at least 1.5 mm towards the bottom of the receptacle 2, at least in its central region, as shown in FIG. 3, when the user presses thereon with a finger, for example.

During deformation, the duct 18 may slide over the chimney 19, without creating significant clearance, and preferably in leaktight manner.

The membrane 12 may also deform laterally, at the periphery 31 of the flocked region. The membrane 12 is more particularly suited to treating a large area of the body or the face, the flocked region extending perpendicularly to the axis X over a distance k that is greater than or equal to 15 mm, when the membrane 12 is observed from above.

The thickness e of the membrane 12 lies in the range 0.2 mm to 5 mm, for example, and better in the range 0.2 mm to 2 mm.

The membrane 12 may be held in various ways on the support 10.

In the embodiment under consideration, the membrane 12 includes, at its periphery, a mounting skirt 26 that includes a portion in relief 27 that is suitable for being snap-fastened in a corresponding portion in relief of the peripheral portion 22 of the support 10.

By way of example, the portion in relief 27 is an annular flange that is arranged to be snap-fastened in a corresponding groove 28 of the support 10, as shown in FIG. 2.

In order to use the device 1, the user may turn said device upsidedown so as to bring the dispenser into a head-down position, thereby enabling the composition P to flow by gravity through the chimney 19 and reach the dispenser orifices 15.

Depending on its viscosity, the composition P may diffuse by capillarity into the flocking 3, once it has passed through the orifices 15.

The deformability of the membrane may make it possible to vary the volume of the inside space 29 that contains the composition, and that is defined by the membrane 12. This may make it possible to generate a small increase in pressure that may force the composition that is being retained by capillarity in the orifices 15 or in the vicinity thereof towards the applicator surface.

The variation in the inside volume 29 is advantageously at least 0.1 mL, better at least 0.5 mL, or even at least 1 mL.

In addition, the deformability of the membrane 12, which need not conserve its initial shape in use, but may match the shape of the treated region, may make the device more comfortable to use.

Figure 4:
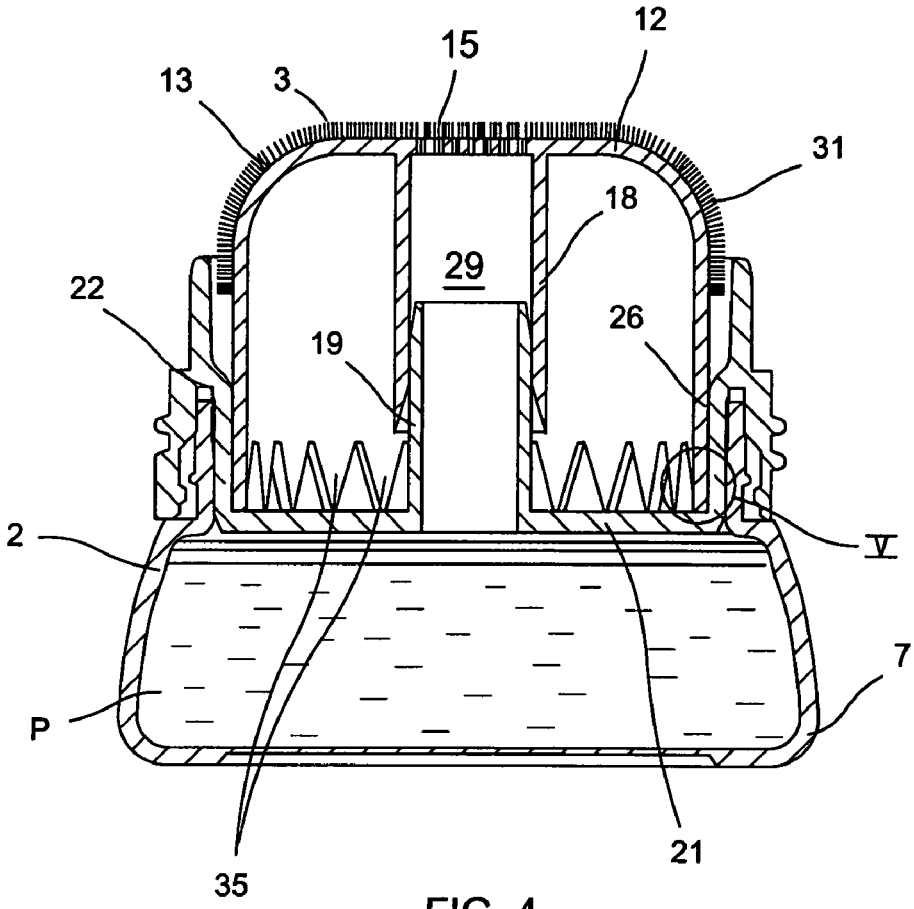
FIG. 4 is a view similar to FIG. 2 showing a variant embodiment.
Figure 5:
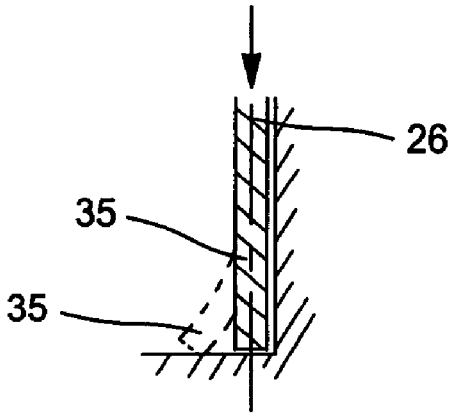
FIG. 5 shows a detail V of FIG. 4.

In the variant in FIG. 4, the membrane 12 is made with flexible tabs 35 that downwardly extend the mounting skirt 26. In the embodiment under consideration, the tabs 35 slope downwards and inwards a little, as shown in FIG. 5, and they may flex so as to enable the mounting skirt 26 to be displaced towards the bottom of the receptacle during use. The tabs 35 may present a cross-section that decreases towards the transverse wall 21 of the support 10, against which they come to bear, and, in a variant (not shown), they may alternatively present a cross-section that varies in some other way, or they may even present a section that is substantially constant.

In the embodiment in FIG. 4, the flocked portion of the membrane may optionally deform during application. Thus it may be advantageous for both the flexible tabs 35 and the flocked portion of the membrane to be deformable.

Figure 6:
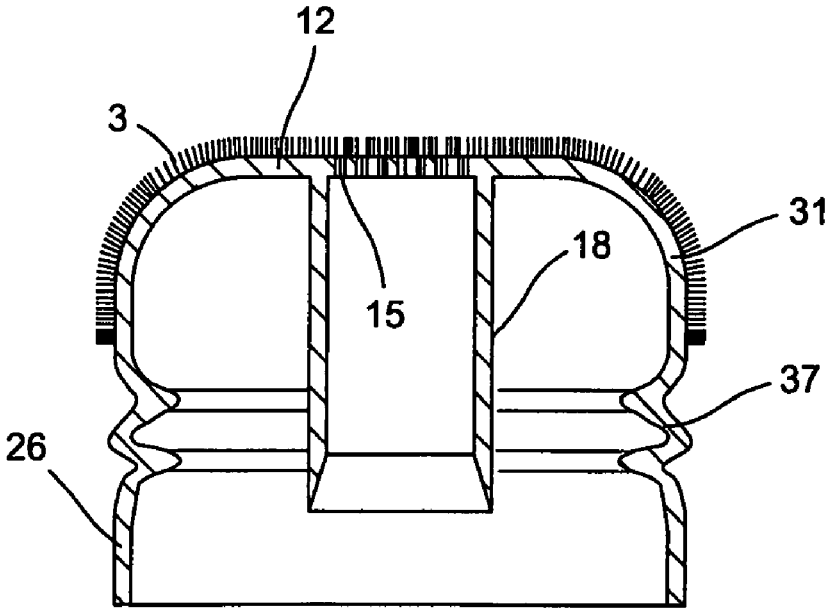
FIG. 6 shows, in isolation, a membrane constituting a variant embodiment of the invention.

In the embodiment in FIG. 6, the mounting skirt 26 is made with a deformable portion 37 that is in the form of a bellows. In a variant (not shown), the mounting skirt 26 is made both with the bellows 37 and with the flexible tabs 35.

Figure 7:
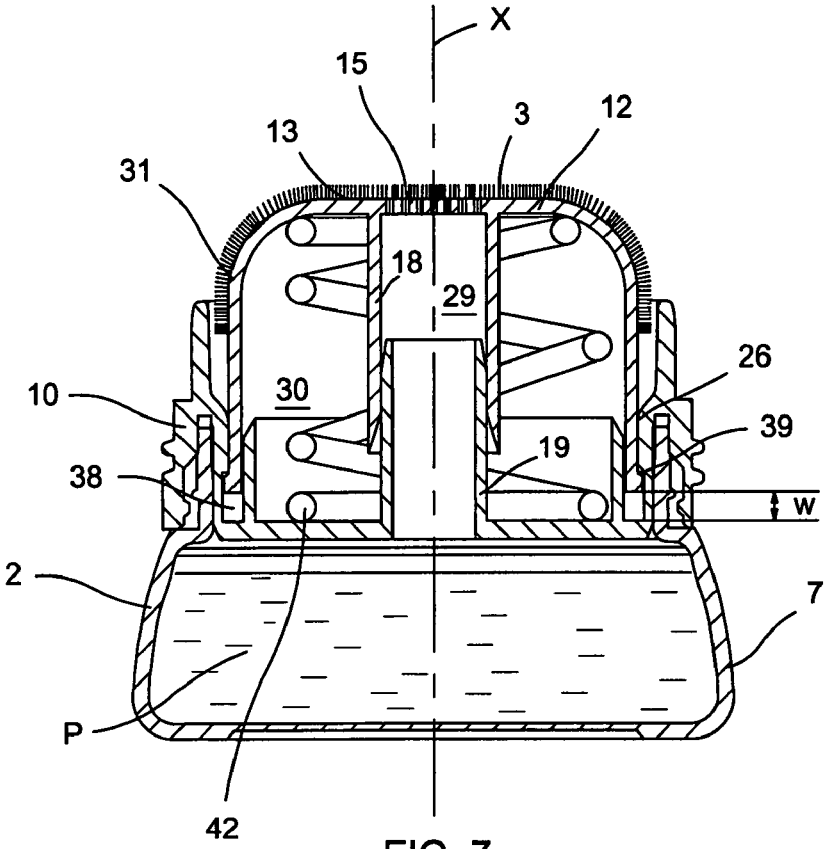
FIGS. 7 to 9 are views similar to FIG. 2 showing variant embodiments of the device.

In the embodiment in FIG. 7, the entire membrane 12 may be displaced towards the bottom of the receptacle, e.g. being capable of sliding downwards through a distance w. In such a variant, the membrane 12 may not be flexible.

The mounting skirt 26 may be made with a portion in relief 39, such as an annular flange, and the support 10 may be made with a groove 38 having a height that is greater than the height of the annular flange 39, thereby making it possible to displace the membrane 12 axially.

Figure 8:
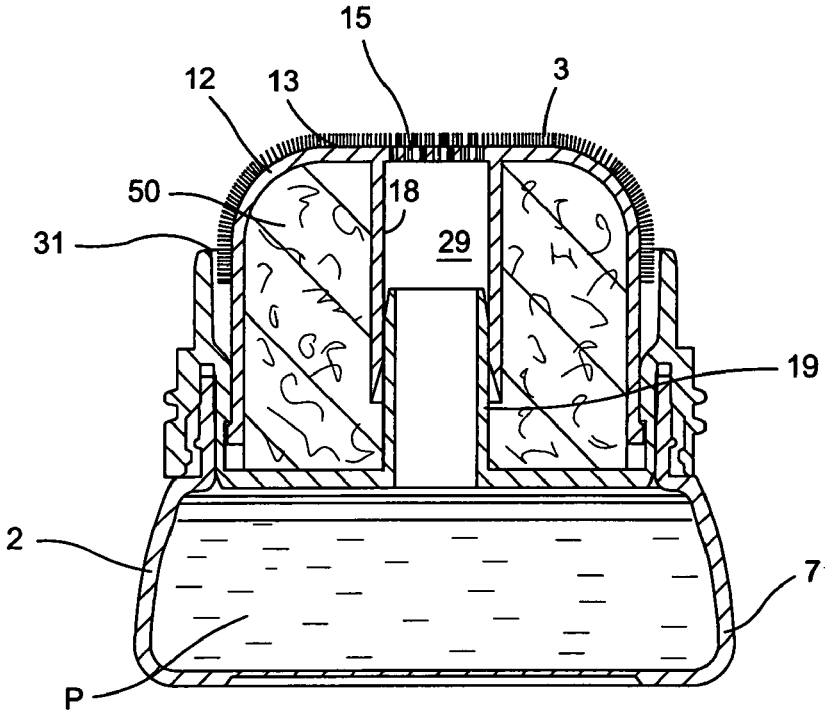

A resilient return member may be disposed in the chamber 30. The resilient return member may be in the form of a spring 42, as in the embodiment in FIG. 7, or it may be in the form of a block of foam 50, as shown in FIG. 8.

Figure 9:
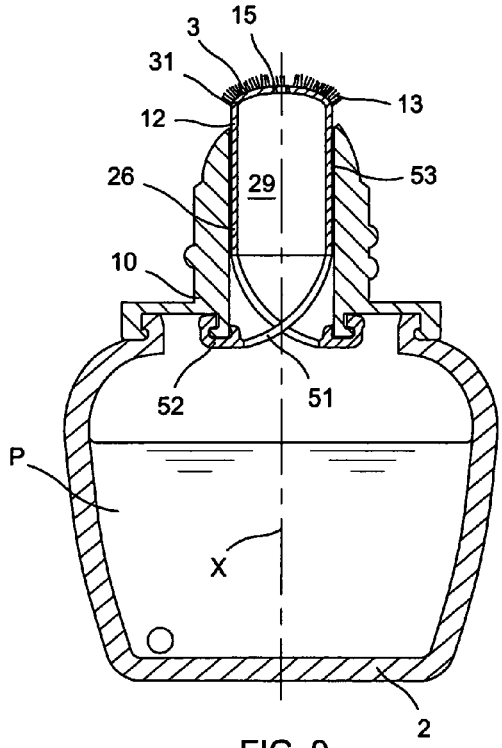

The membrane 12 may also be made as a single piece together with an elastically-deformable return member 51 by molding a plastics material, said return member being arranged to bear against a wall of the receptacle, for example, or, as shown in FIG. 9, to be fastened on the support 10 by means of a fastener portion 52.

In a variant (not shown), the membrane is molded as a single piece with the support and/or the reservoir, e.g. by dual-injection of two materials. The membrane may thus be molded in a flexible material.

In the embodiment in FIG. 9, the membrane 12 does not have the duct 18 of the above-described embodiments, and the mounting skirt 26 is arranged to slide in substantially leaktight manner in a neck 53 of the support 10, for example.

The membrane 12 may be made with various shapes at rest, as a function of the nature of the composition, and of the region to be treated, for example.

Figure 10:
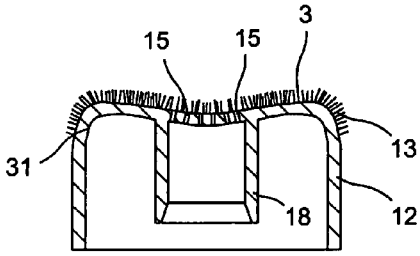
FIGS. 10 to 14 show, in isolation and in axial section, other embodiments of the membrane.

For example, in its region covered by the flocking 13, the membrane 12 may present a shape that is generally outwardly concave, as shown in FIG. 10, the orifices 15 being situated, for example, at the bottom of the concave region, radially inside the duct 18.

A generally concave shape may make it easier to irrigate the bristles of the flocking by capillarity, and it may make it easier to dry the skin or the hair by capillarity.

Figure 11:
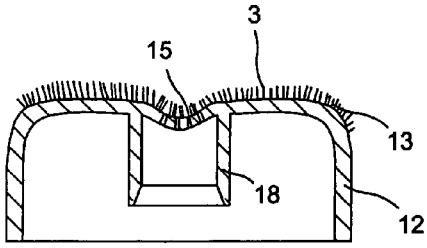

In the variant in FIG. 11, the concave region of the membrane 12 is restricted to a region of the membrane 12 that is radially inside the duct 18.

Figure 12:
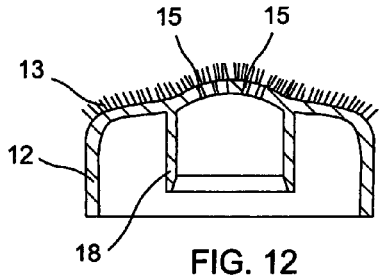
Figure 13:
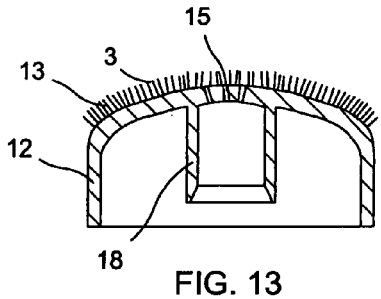

In the embodiment in FIG. 12, the membrane 12 presents a shape that is generally outwardly convex over its portion that is covered by the flocking 13, and in the embodiment in FIG. 13, the convexity of the membrane 12 is restricted to the portion that is radially inside the duct 18.

Figure 14:
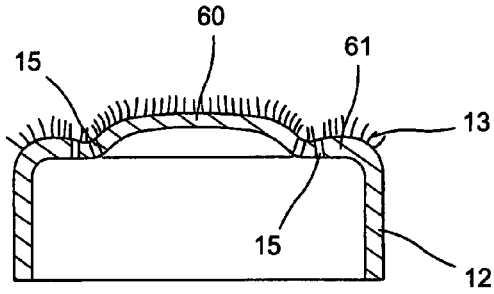

In the embodiment in FIG. 14, the membrane 12 presents a shape that is stepped, with a portion 60 that is raised relative to a peripheral portion 61, the dispenser orifices 15 being situated substantially at the junction of the portions 60 and 61.

The dispenser orifices 15 may be distributed in various ways over the applicator surface.

Figure 15:
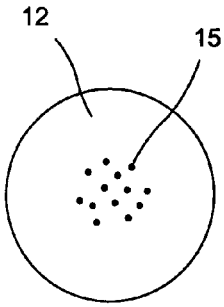
FIGS. 15 to 20 are diagrammatic plan views showing examples of locations and/or shapes for the dispenser orifices.
Figure 16:
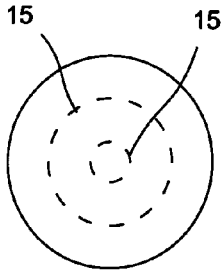
Figure 17:
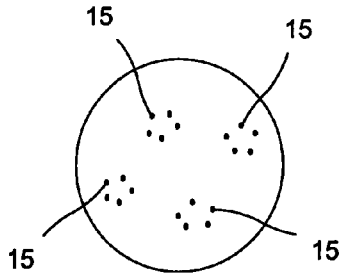

By way of example, the dispenser orifices 15 may be grouped at the centre as shown in FIG. 15, may be distributed in concentric circles, as shown in FIG. 16, or may be grouped in clusters as shown in FIG. 17.

Figure 18:
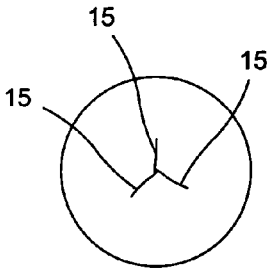
Figure 19:
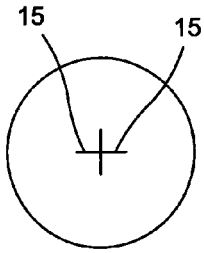
Figure 20:
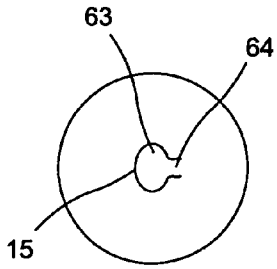

The dispenser orifices may also be in the form of slots, e.g. a plurality of slots that are joined together at one end, as shown in FIG. 18, two slots that intersect, e.g. at right angles, as shown in FIG. 19, or a single slot, the slot presenting a rectilinear shape, for example, or, as shown in FIG. 20, a keyhole shape defining a portion 63 that is capable of raising under the effect of the pressure of the composition, and that is fastened at rest to the membrane by a material bridge 64. The dispenser orifices may also be formed by perforating a grid.

The dispenser orifice(s) 15 may be closed at rest, and may open under the effect of the pressure of the composition.

Figure 21:
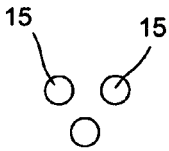
FIGS. 21 to 23 are cross-section views showing examples of dispenser orifices.
Figure 22:
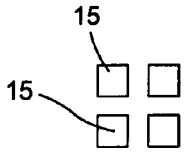
Figure 23:
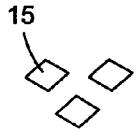

The dispenser orifices may also be permanently open, as shown in FIGS. 21 to 23, and may present a cross-section that is circular, as shown in FIG. 21, or polygonal, for example square, as shown in FIG. 22, or lozenge-shaped, as shown in FIG. 23. A polygonal section may increase the ability to retain the composition by capillarity.

Figure 24:
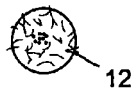
FIGS. 24 to 29 are plan views showing examples of membranes.
Figure 25:
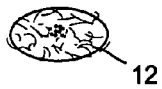
Figure 26:
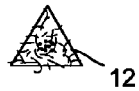
Figure 27:
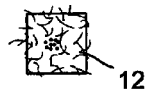
Figure 28:
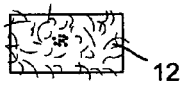

When the membrane 12 is observed from above, said membrane may present various shapes, and for example a circular shape, as shown in FIG. 24. The membrane 12 may also present a shape that is elongate, as shown in FIG. 25, polygonal, in particular substantially triangular, as shown in FIG. 26, substantially square, as shown in FIG. 27, or substantially rectangular, as shown in FIG. 28.

Figure 29:
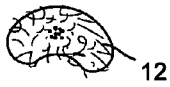

The membrane 12 may also be substantially kidney-shaped when observed from above, as shown in FIG. 29.

Figure 30:
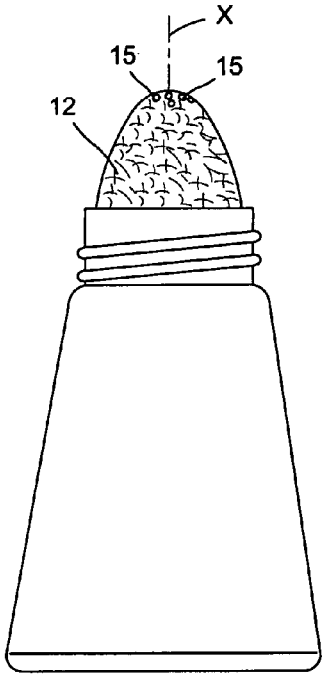
FIG. 30 is an elevation view of a device constituting an embodiment of the invention.

The membrane 12 may be generally dome shaped, with the orifices 15 being present substantially at the top of the dome, as shown in FIG. 30.

Figure 31:
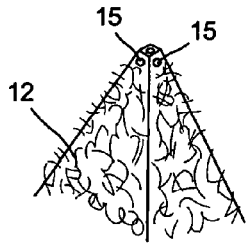
FIG. 31 is a perspective view showing, in isolation, another embodiment of the membrane.

The dome may be circularly symmetrical about the axis X, as in the embodiment in FIG. 30. The dome may also be pyramid shaped, as shown in FIG. 31.

Figure 32:
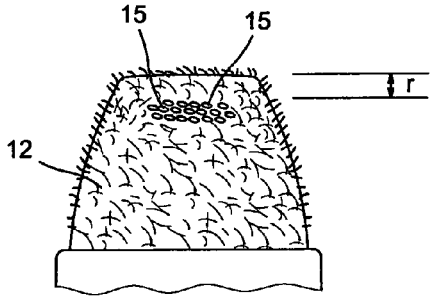
FIG. 32 is a fragmentary elevation view showing another device.

Whatever the shape of the membrane, the dispenser orifice (s) 15 may be situated at its top, or may open out only on a side face of the membrane 12, as shown in FIG. 32.

In this figure, it may be seen that the dispenser orifices 15 are situated at a certain distance r from the top of the membrane 12, the distance r being a few millimeters, for example.

Figure 33:
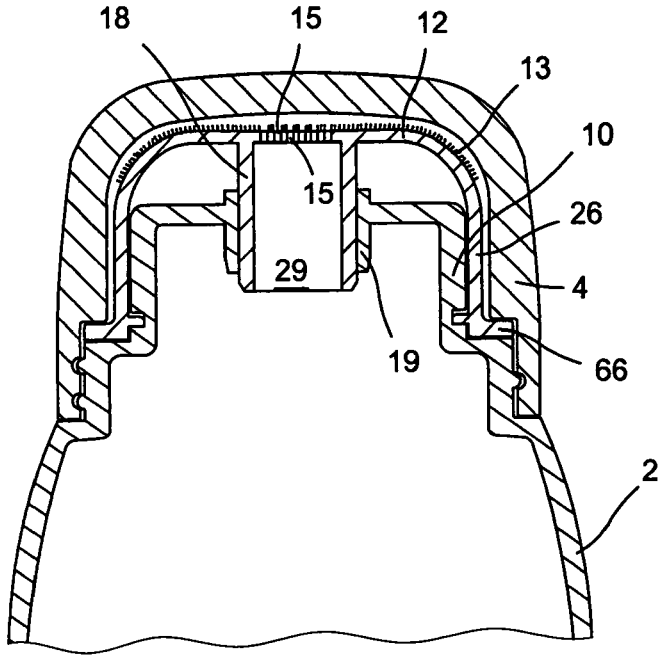
FIGS. 33 to 39 are diagrammatic and fragmentary longitudinal-section views showing variant embodiments of the dispenser head.

The membrane 12 may be made with a rim 66 at its periphery, and the cap 4 may be made in such a manner as to bear against the rim 66 when the cap is put into place on the reservoir 2, as shown in FIG. 33. This may make it possible to close the device in leaktight manner.

In this figure, it may also be seen that the mounting skirt 26 may cover the outside of the support 10, which is formed by the top portion of the reservoir 2, for example.

As shown, the duct 18 may be inserted into the chimney 19.

Figure 34:
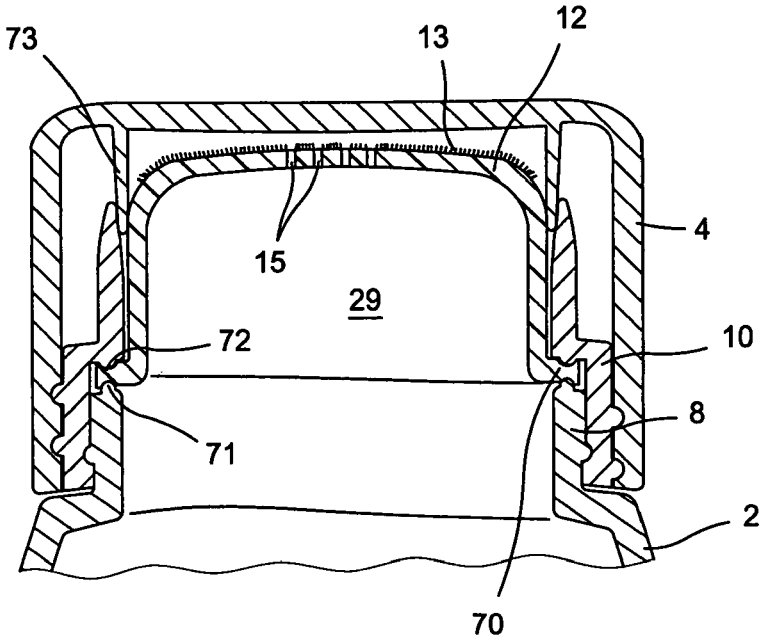

In the variant in FIG. 34, the membrane 12 is made with a rim 70 that is pinched between the neck 8 of the reservoir 2 and the support 10 which is fitted on the reservoir 2.

By way of example, the neck 8 is made with an annular rib 71 and the support 10 is made with a corresponding annular rib 72, in such a manner as to pinch the rim 70 effectively.

The cap 4 may include a sealing skirt 73 that bears against the support 10 when the cap 4 is put into place on the reservoir 2, as shown. In this figure, it may also be seen that the membrane 12 may be made without the duct 18.

Figure 35:
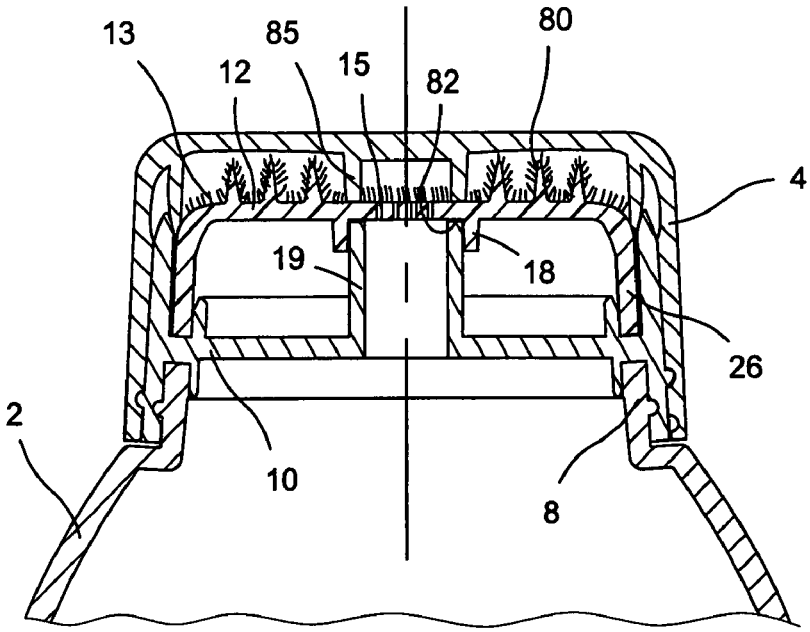

In the variant in FIG. 35, the membrane 12 is made with portions in relief 80 that are covered by the flocking 13, and that are intended to treat the hair, for example. The membrane 12 may bear against the top end 82 of the chimney 19, such that only the portions of the membrane 12 that are situated radially between the mounting skirt 26 and the duct 18 may deform during use.

Figure 36:
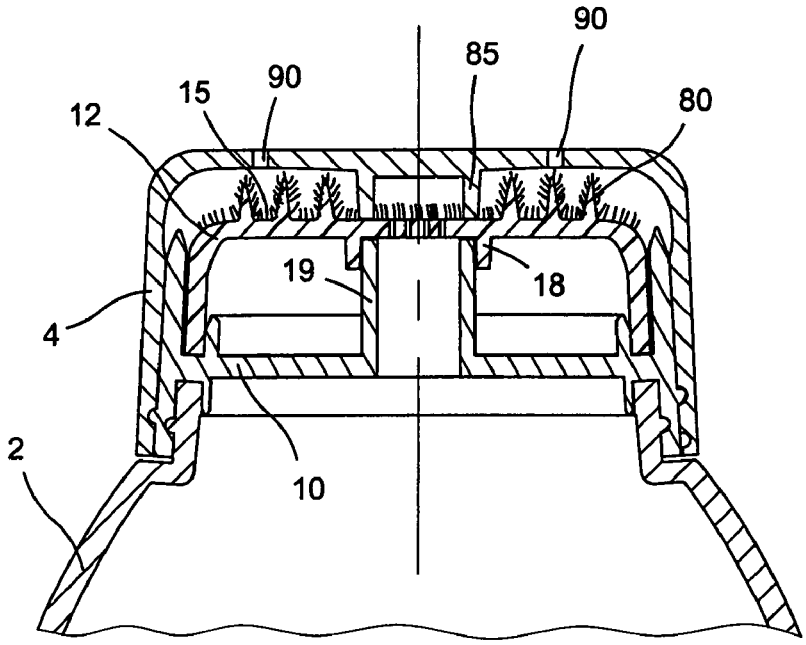

The cap 4 may be made with a lip 85 that bears against the membrane 12 on the side remote from the chimney 19 so that the membrane 12 is clamped between the chimney 19 and the lip 85 while the cap 4 is in place. In this way, it may be possible to reduce the risk of composition flowing over the flocked surface of the membrane that extends radially beyond the lip 85. This may make it possible, where appropriate, to make air vents 90 in the cap 4, as shown in FIG. 36, so as to make it easier to dry the flocking 13 around the lip 85.

In a variant (not shown), the cap includes a portion that is arranged to bear against the membrane and to compress it in the region of the dispenser orifices so as to prevent composition from escaping therethrough.

The dispenser orifice(s) 15 may be permanently in communication with the inside space of the reservoir containing the composition. This may not necessarily be so, and the device may include a system that makes it possible to interrupt fluid communication between the dispenser orifice(s) 15 and the inside of the reservoir.

Figure 37:
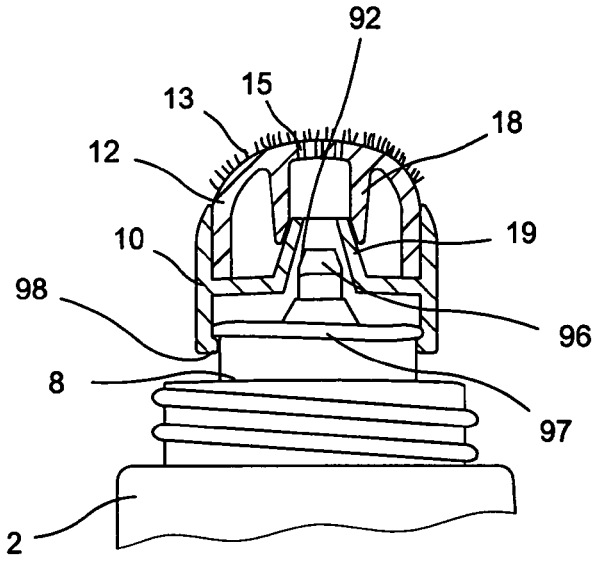

In the embodiment in FIG. 37, the support 10 is movable relative to the reservoir 2 between a first position in which the composition can flow, from the inside space of the reservoir containing the composition to the dispenser orifices 15, through an annular passage 92 defined between the chimney 19 and a nozzle 96 that is secured to the reservoir 2, and a second position in which the support 10 closes the passage 92.

The support 10 is movable on the neck 8 of the reservoir 2, being retained thereon firstly by means of a collar 97 formed at the top end of the neck 8, and secondly by means of one or more portions in relief such as teeth or an annular flange formed on the support, for example.

In the embodiment in FIG. 37, it may be observed that the chimney 19 may be made with a frustoconical shape, so as to make it easier to close the device when the nozzle 96 is pushed against said chimney.

Passing from the open position to the closed position, and vice versa, may be performed by the support 10 being moved in translation, for example, or, in a variant, by said support being turned, at least one of the support and of the reservoir 2 then including a ramp making it possible to transform such turning movement into axial displacement of the chimney 19 relative to the nozzle 96.

Figure 38:
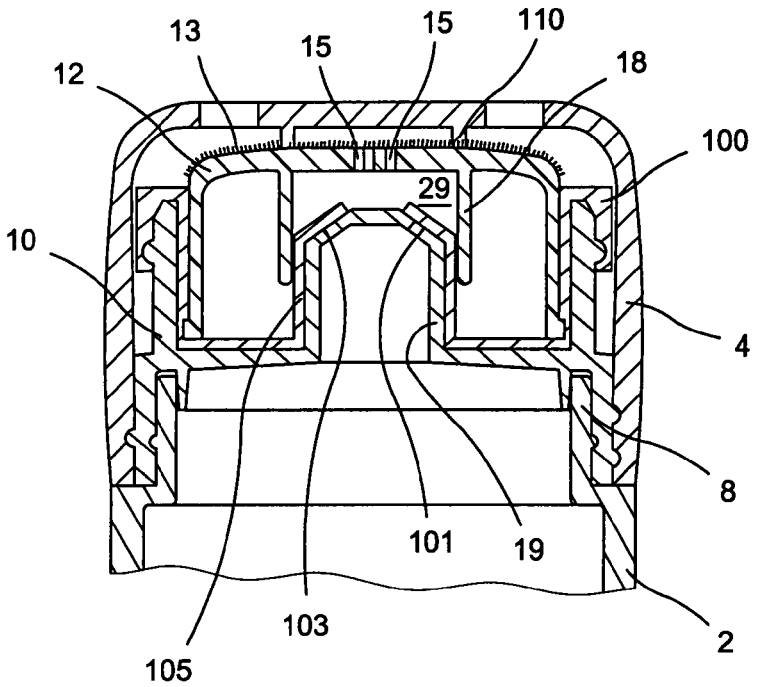

As shown in FIG. 38, the interrupter system for interrupting communication between the dispenser orifice(s) 15 and the inside of the reservoir may also be made by means of a disk 100 that is capable of turning on the support 10 between an open position and a closed position. The disk 100 may be snap-fastened on the support 10, and may include sectors 101 that are arranged to close orifices 103 that make it possible to put the dispenser orifices 15 into communication with the inside of the reservoir 2.

In this embodiment, the duct 18 bears against a chimney 105 of the disk which is guided in turning by the chimney 19 of the support 10, for example. The membrane 12 may turn with the disk 100.

As shown in FIG. 38, the cap 4 may be made with a lip 110 that bears against the membrane 12 in such a manner as to reduce the risk of composition flowing over the flocking 13 other than in the region that is radially inside the lip 110.

Figure 39:
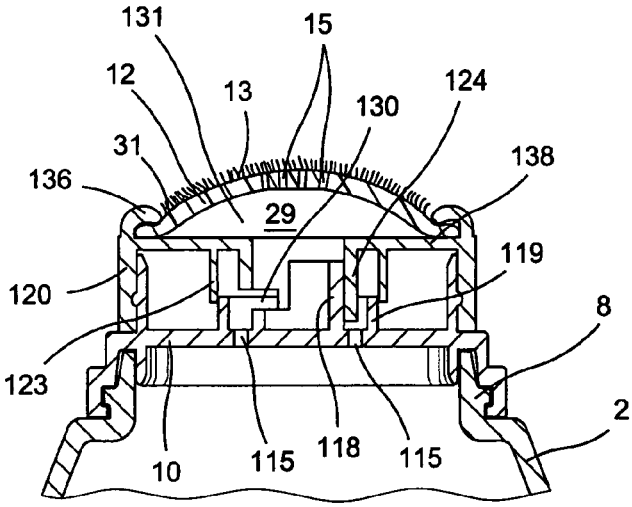
Figure 40:
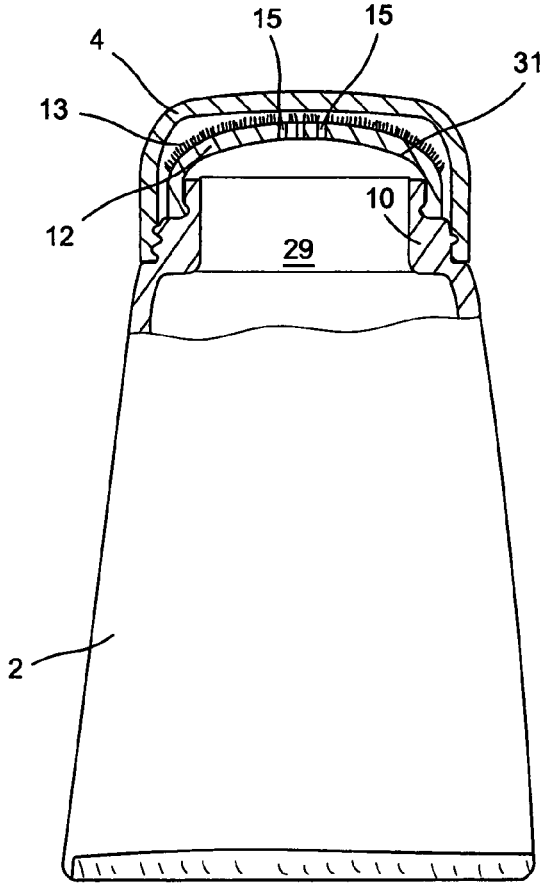
FIGS. 40 to 45 are elevation views, in partial section, showing other variant embodiments.

FIG. 39 shows another embodiment in which the support 10 presents a transverse wall through which there pass orifices 115 that open out between two coaxial skirts 118 and 119.

A disk 120 turns on the support 10 and includes two skirts 123 and 124 that are connected to a transverse wall 138 and that bear against the skirts 119 and 118 respectively. Permanent sealing is obtained by means of the skirt 123 being in contact with the skirt 119.

For a predefined angular position of the disk 120 relative to the support 10, a passage 130 is established, making it possible to feed a space 131 below the membrane 12. The membrane may be fastened on the disk 120 by means of a folded-back edge 136 of said disk, which folded-back edge clamps a peripheral portion of the membrane 12 against the transverse wall 138.

In all of the embodiments described above, in order to dispense the composition, and when the viscosity of the composition allows it, the user may position the device head-down so that the composition flows by gravity. The user may also shake the reservoir 2.

The user may deform and/or displace the membrane in such a manner as to encourage composition to pass through the dispenser orifice(s).

Where appropriate, the reservoir may be made with a flexible wall so as to enable the user to reduce its the inside volume so as to force the composition to flow through the dispenser orifice(s). By way of example, the reservoir 2 may be in the form of a flexible tube.

Figure 41:
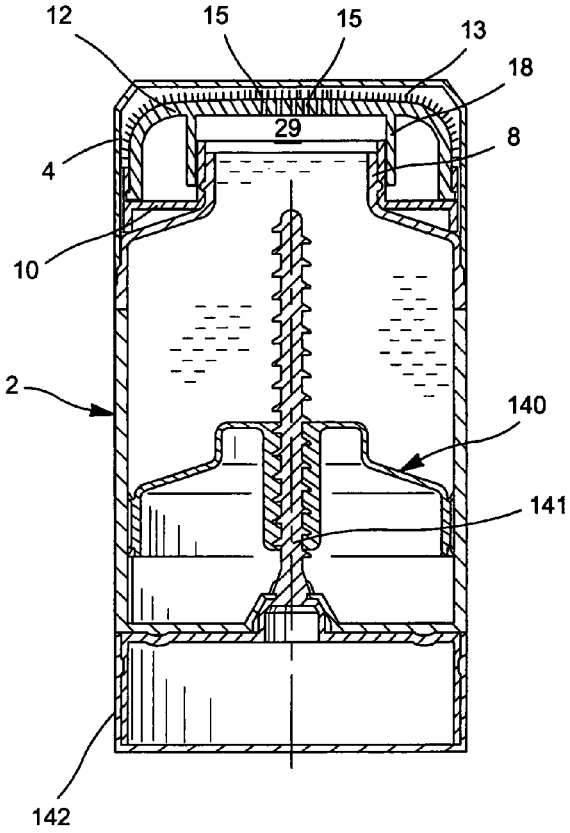

As shown in FIG. 41, the reservoir 2 may also be made with a piston 140 that may be driven by a screw 141 and by a knob 142. By turning the knob 142, the user may force the composition to flow through the neck 8 of the reservoir towards the dispenser orifices 15.

Figure 42:
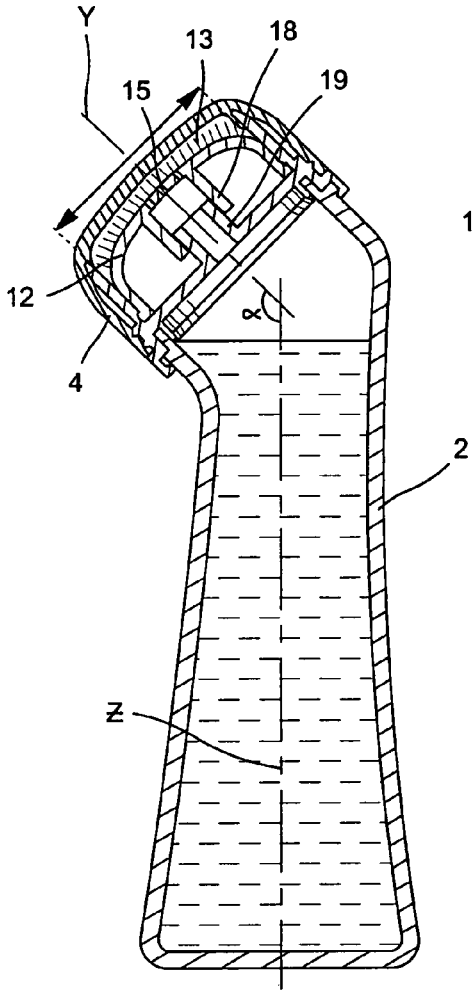

The membrane may present a shape that is generally symmetrical about an axis Y forming an angle $\alpha$ with a longitudinal axis Z of the reservoir 2, as shown in FIG. 42.

Figure 43:
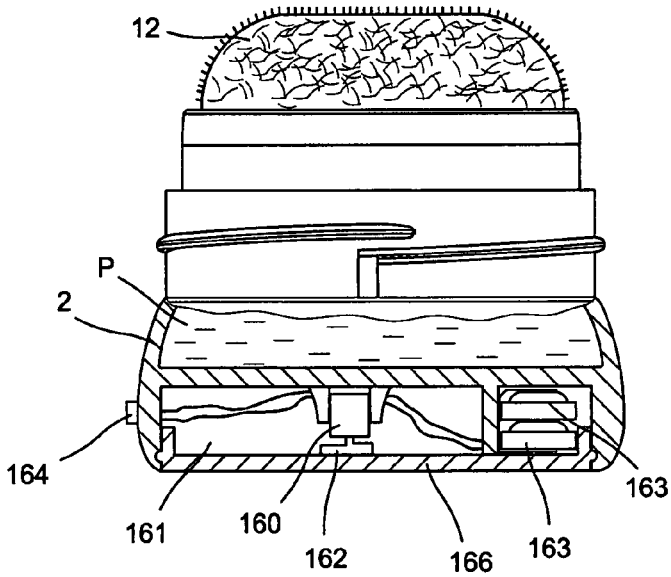

The device may be made with a source of vibration, which, by way of example and as shown in FIG. 43, comprises an electric motor 160 in a compartment 161 of the reservoir 2, said compartment being isolated from the compartment containing the composition. The electric motor 160 may drive an off-center fly-weight 162 in such a manner as to produce vibration.

The electric motor 160 may be powered by one or more batteries, in particular button cells 163.

A switch 164 may be provided for switching on the motor 160.

The reservoir 2 may include a removable bottom 166 making it possible to replace the batteries 163.

The vibration may make it possible to modify, as desired, the thickness of the layer being deposited, and/or the composition flowrate, and/or makes it possible to stimulate the region being treated.

In a variant, the vibration source may also be removable, and/or it may enable the user to modify the frequency of the vibration.

Figure 44:
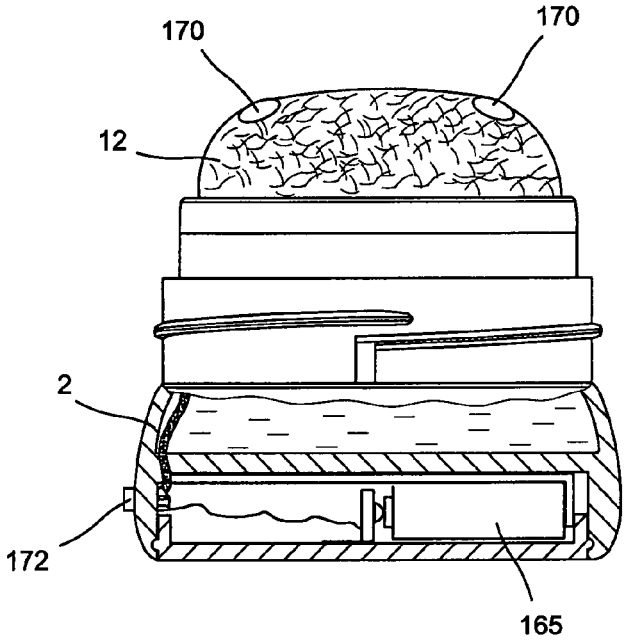

As shown in FIG. 44, the device may also be made with electrodes 170 that are suitable for being connected to an electricity source 165, e.g. a 1.5 volt (V) to 9 V battery, by means of a switch 172. The membrane may be made of an electrically-conductive or insulating material depending on the disposition of the electrodes, for example.

Figure 45:
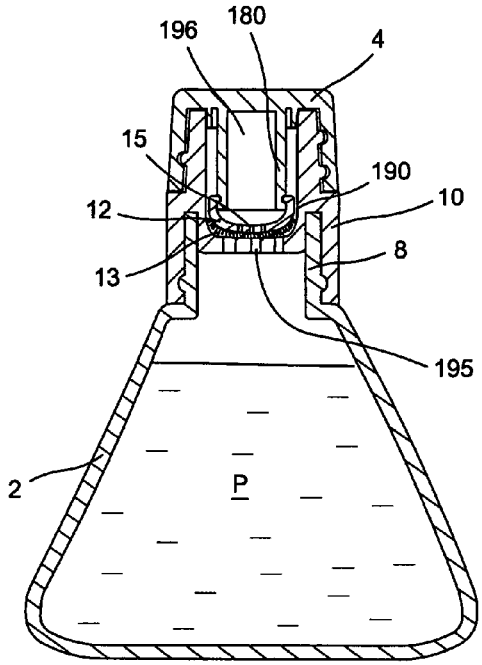

The membrane 12 may not be secured to the reservoir 2 during application, but is secured to said reservoir in the closed configuration, as shown in FIG. 45. In this figure, it may be seen that the closure cap of the reservoir may be made with a chimney 180 that serves as a support for the membrane 12. The support 10 may define a housing 190 in which the membrane 12 is received, and in the bottom of which orifices 195 open out enabling the composition to flow towards the membrane 12.

When the device is closed and turned upsidedown, composition P is likely to flow through the orifices 195 and through the orifices 15 of the membrane 12 so as to accumulate in the chamber 196 formed inside the chimney 180. The composition accumulated in this way constitutes a reserve that may increase the length of time the applicator may be used.

In addition, while the membrane 12 is being deformed, a pumping effect may occur.

Composition may be absorbed while the membrane 12 is relaxing, which relaxation is accompanied by an increase in the volume of the chamber 196.

Deforming the membrane also makes it possible to create an increase in pressure, forcing the composition present in the chamber 196 through the dispenser orifices 15 by reducing the volume of said chamber.

Figure 46:
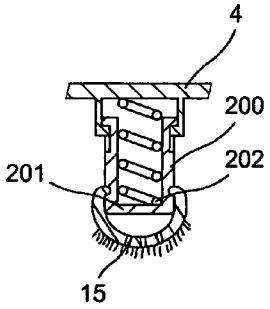
FIG. 46 shows a detail of a variant embodiment of the FIG. 45 device.

FIG. 46 shows a variant embodiment of the FIG. 45 device, in which the membrane 12 is mounted on a holding part 200 that is movable relative to the cap 4.

The holding part 200 includes a transverse wall 201 against which one end of a spring 202 bears, the other end of said spring bearing against the cap 4.

Figure 47:
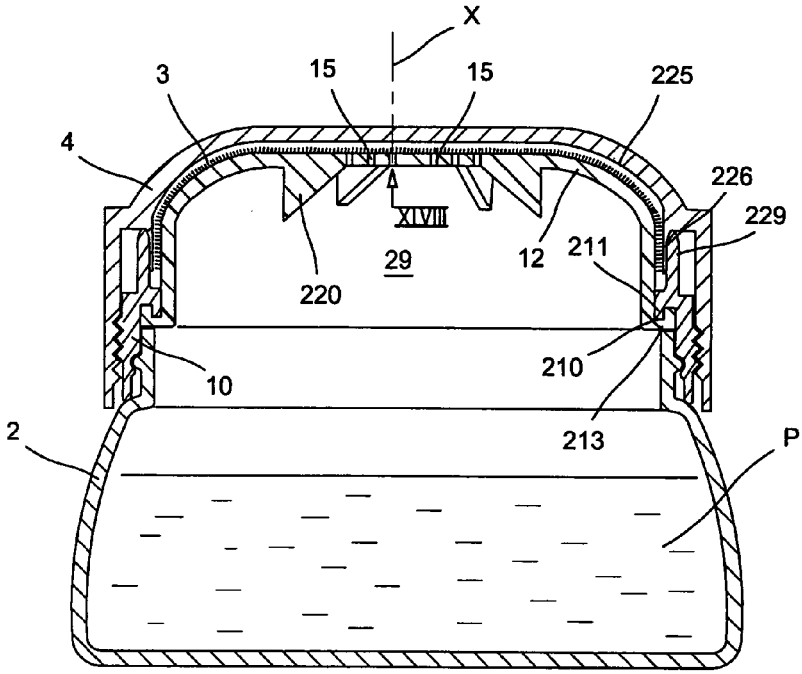
FIG. 47 is a longitudinal section view of a device constituting a variant embodiment.

The device shown in FIG. 47 includes a membrane 12 that presents, at its periphery, an annular rim 213 that is engaged between the neck of the reservoir 2 and the support 10 that is constituted by a part fitted thereto.

The rim 213 of the membrane includes an annular groove 210, and the support 10 includes a corresponding annular lip 211 that is engaged in the groove 210. This makes it possible to improve sealing where the membrane is mounted on the reservoir 2 and on the support 10.

Figure 48:
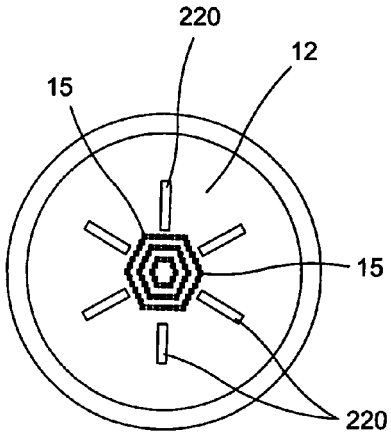
FIG. 48 is a view on XLVIII of FIG. 47 showing the membrane only.

This figure also shows the possibility of making the membrane 12 with stiffener fins 220 over its inside face, which fins are distributed angularly about the axis X, as may be seen in FIG. 48.

The presence of the fins 220 makes it possible to improve the strength of the membrane 12 during application.

Figure 53:
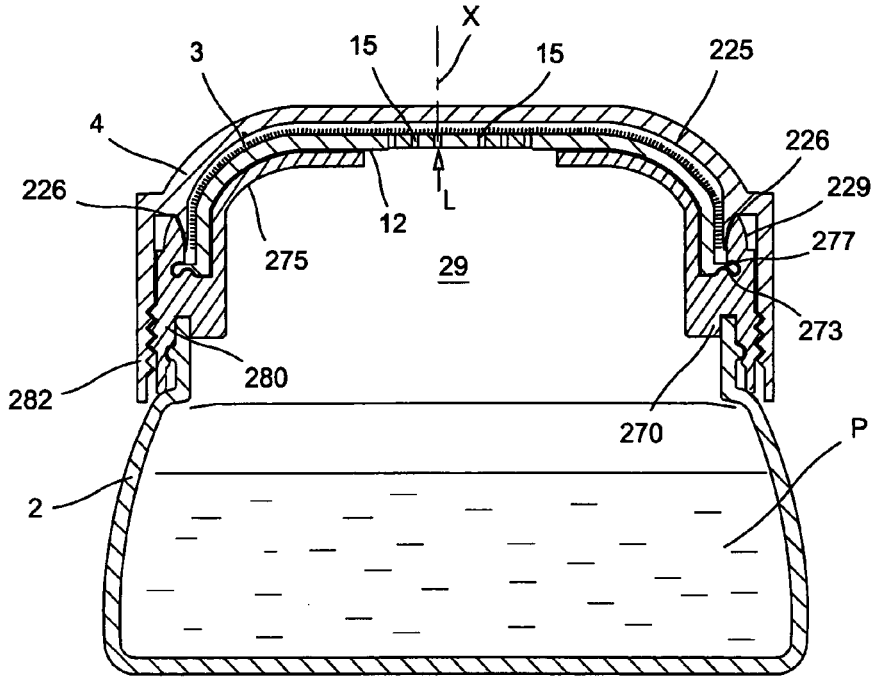
FIG. 53 is a longitudinal section view of a device constituting a variant embodiment.

FIG. 53 shows a variant embodiment, in which the device includes a bearing part 280.

The bearing part 280 is made for example of non-elastomer plastic material and may play the same role as the support 10 of the embodiments described above.

The material of the bearing part may be more rigid than the material of the membrane.

In the embodiment shown, the bearing part 280 is fitted to the reservoir and includes an annular portion 270 on which projects an annular bead 273 engaged in a corresponding groove 272 of the membrane 12.

The bearing part 280 may include portions in relief 282 such as a thread enabling the cap 4 to be fitted thereon.

In the embodiment shown, the bearing part 280 is fitted on the neck 8 of the receptacle 2 and the membrane 12 is fitted on the bearing part 280 but the bearing part 280 may be fitted on the neck 8 and the membrane 12 may be fitted on the bearing part 280 thanks to at least one additional part.

The bearing part 280 includes elements that limit the deformation of the membrane, for example flexible fins 275 that contact the inside face of the membrane 12.

Figure 54:
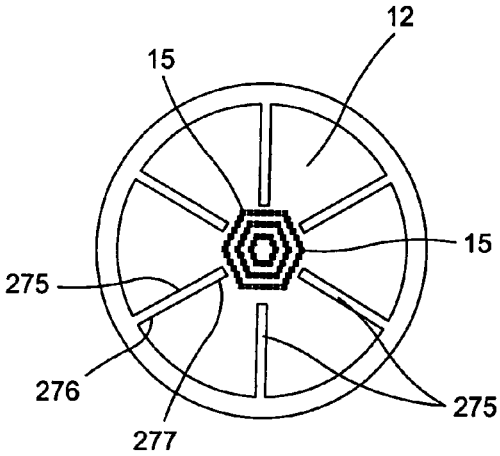
FIGS. 54 and 55 are partial and schematic views from under along L of FIG. 53 showing the membrane only.
Figure 55:
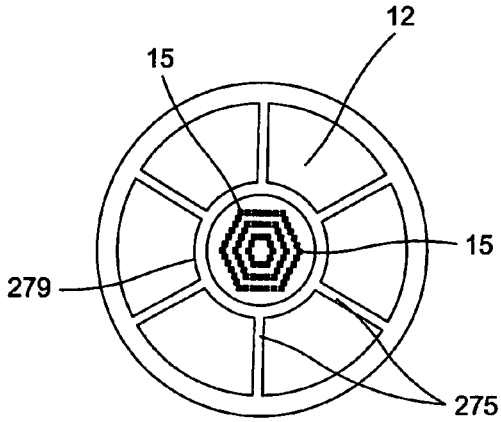

The fins 275 may for instance be distributed angularly about the axis X, as may be seen in FIGS. 54 and 55 and their number may be equal to six.

FIG. 54 shows an embodiment in which the fins 275 include a proximal portion 276 connected to the annular portion 270 and a free distal portion 277.

The fins 275 may have or not a constant width, having for instance a proximal portion wider than their distal portion.

FIG. 55 shows a variant embodiment in which the distal portions 277 of the fins 275 are connected together by an annular portion 279.

The annular portion 279 may have openings that may coincide with the orifices 15.

In a variant not shown, the fins 275 may be formed on the neck 8 of the receptacle.

The presence of the fins 275 may improve the holding of the shape of the membrane 12 by limiting the deformation of the membrane during application.

The cap 4 may present an inner surface 225 that substantially matches the shape of the flocked region of the membrane 12, in such a manner as to reduce the volume of the space defined between the membrane 12 and the cap 4 in the closed configuration of the device. The cap 4 may be made with an annular sealing lip 226 that comes to bear against an annular riser 229 of the support 10, as shown in FIGS. 47 and 53.

Figure 49:
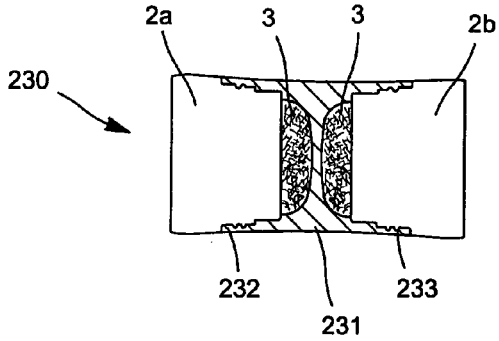
FIGS. 49 and 50 are diagrammatic views, in partial section, showing variants.
Figure 50:
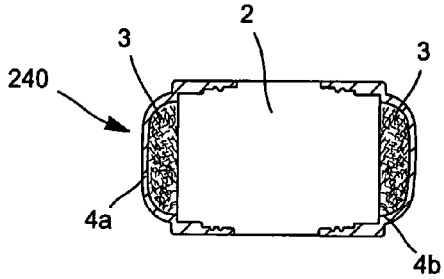

A plurality of devices made in accordance with the invention may be associated within sets 230 or 240, as shown diagrammatically in FIGS. 49 and 50.

The set 230 comprises two reservoirs 2*a* and 2*b*, and two corresponding flocked membranes, the reservoirs being suitable for being joined together by a coupling part 231 that also serves as a closure cap for each of the reservoirs.

By way of example, the coupling part 231 includes threads 232 and 233 for being screw-fastened on the reservoirs 2*a* and 2*b* respectively.

By way of example, the reservoirs 2*a* and 2*b* contain two compositions having different shades, or compositions having different sun protection factors. It is also possible to have two compositions for applying in succession, such as a base coat and a top coat.

In the set 240, the flocked membranes are disposed at the ends of the device and may be covered by respective caps 4*a* and 4*b*.

The reservoir 2 is common to both flocked membranes, and, by way of example, includes two compartments containing different compositions to be dispensed respectively by the membranes associated with the caps 4*a* and 4*b*.

In a variant (not shown), the reservoir 2 contains a single composition, and the flocked membranes present different shapes, e.g. one being adapted to treat the body other than on the face and the other being adapted to treat the face.

Figure 51:
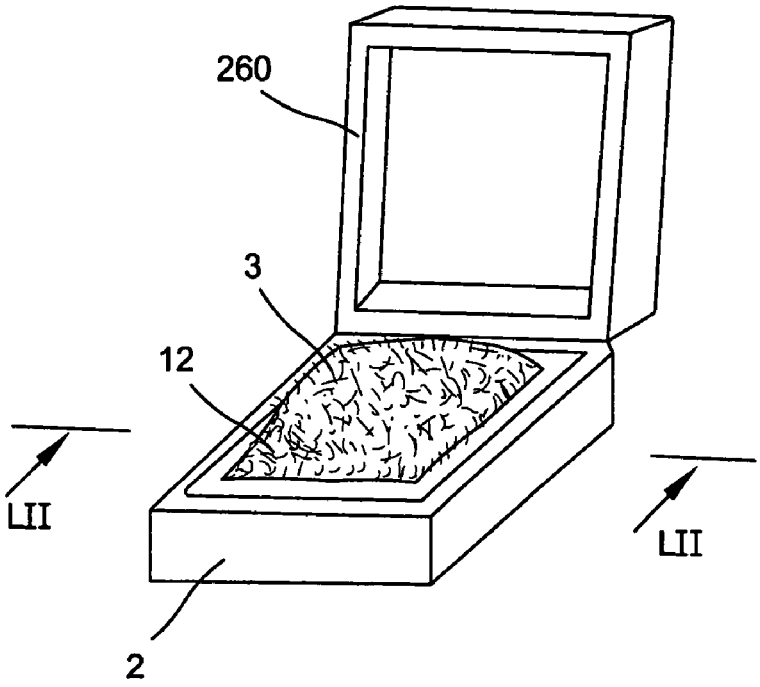
FIG. 51 is a diagrammatic perspective view showing another example of a device constituting an embodiment of the invention.
Figure 52:
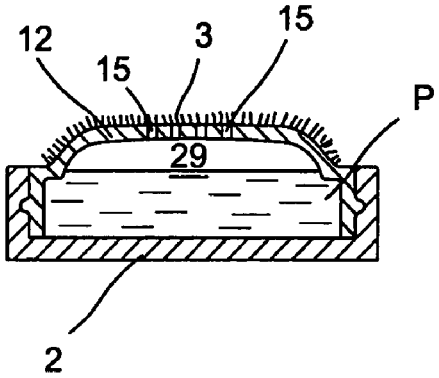
FIG. 52 is a section on LII-LII of FIG. 51.

In the variant in FIG. 51, the reservoir 2 is in the form of a compact that may be closed by means of a lid 260, which, in the embodiment under consideration, is hinged, but may be fastened in some other way on the reservoir 2, e.g. by being screw-fastened or snap-fastened on said reservoir. Composition is taken from the membrane 12 by pressing a finger thereon, for example. Deforming the membrane may reduce the inside volume below the membrane, and the resulting increase in pressure may force the composition that is being retained by capillarity in the orifices 15 towards the outer surface of the membrane. By way of example, composition may be taken after shaking the reservoir.

The invention is not limited to the embodiments shown.

The features of the various embodiments described above may be combined with one another in embodiments that are not shown.

For example, it is possible to provide any of the devices described above with a vibration source.

It is possible to provide any one of the reservoirs shown in the figures with any one of the membranes shown.

The dispenser orifices may be distributed in accordance with any one of FIGS. 15 to 20.

The section of the dispenser orifices 15 may be as shown in FIGS. 21 to 23, and the same applies to the shape, in plan view, of the flocked membrane.

The vibrator source may also be carried by the support.

In all of the embodiments, when the composition is colored, the membrane may advantageously be made substantially in the same color as the composition. The flocking could be white. When the flocking is wet with the composition, the color of the membrane might appear, thereby making it more difficult to see the composition on said membrane, and consequently improving the appearance of the device.

The membrane may be made in such a manner as to present the possibility of deforming not only along the axis of the housing that receives it, but also transversally thereto.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

The expression "comprising a" should be understood as being synonymous with "comprising at least one", unless specified to the contrary.

What is claimed is:

1. A packaging and applicator device, comprising:

a reservoir containing at least one composition for application;

a support that is secured to the reservoir during application and/or when the device is in a closed configuration; and a non-porous membrane that is carried by the support, comprising at least one dispenser orifice passing therethrough for dispensing the composition, and being externally covered, at least in part, by flocking, the membrane co-operating with the support and/or with the reservoir to define an inside space containing the composition, the membrane being flexible and/or mounted on the support and/or on the reservoir so as to be able to be deformed and/or be displaced relative to the support and/or to the reservoir, resulting in a reduction in the volume of the inside space of at least 0.1 mL, wherein the membrane is molded with at least one duct communicating with the dispenser orifice(s).

2. A device according to claim 1, the reduction in volume being at least 0.5 mL.

3. A device according to claim 1, the reduction in volume being at least 1 mL.

4. A device according to claim 1, the reduction in volume being at least 1.5 mL.

5. A device according to claim 1, the reduction in volume being at least 2 mL.

6. A device according to claim 1, the reduction in volume being at least 3 mL.

7. A device according to claim 1, wherein at least a portion of the membrane is capable of being displaced during use by at least 1.5 mm relative to the support and/or to the reservoir.

8. A device according to claim 1, wherein at least a portion of the membrane is capable of being displaced during use by at least 3 mm relative to the support and/or to the reservoir.

9. A device according to claim 1, the membrane having a thickness lying in the range 0.2 mm to 5 mm.

10. A packaging and applicator device according to claim 1, in which the duct slides in or over a chimney of the device.

11. A packaging and applicator device according to claim 10, in which the chimney belongs to the support.

12. A packaging and applicator device according to claim 1, the composition presenting a certain color, and the membrane being made in substantially the same color.

13. A packaging and applicator device according to claim 1, the membrane being molded with a peripheral skirt.

14. A packaging and applicator device according to claim 13, the peripheral skirt of the membrane being of height that is greater than or equal to 10 mm.

15. A packaging and applicator device according to claim 13, in which the peripheral skirt enables the entire membrane to be depressed relative to the support.

16. A packaging and applicator device according to claim 13, in which the peripheral skirt comprises an elastically-deformable portion.

17. A packaging and applicator device according to claim 13, in which the peripheral skirt rests against the bottom of a housing of the support and/or of the reservoir receiving the membrane.

18. A packaging and applicator device according to claim 1, in which the membrane presents an outer surface that is concave.

19. A packaging and applicator device according to claim 1, in which the membrane presents an outer surface that is convex.

20. A packaging and applicator device according to claim 1, in which the dispenser orifice(s) is/are situated in a recess of the membrane.

21. A packaging and applicator device according to claim 1, in which the dispenser orifice(s) is/are situated at the top of a boss of the membrane.

22. A packaging and applicator device according to claim 1, the membrane presenting, in its flocked portion, a shape that is circularly symmetrical.

23. A packaging and applicator device according to claim 1, in which the deformation and/or displacement distance of at least a portion of the membrane is at least 5 mm.

24. A packaging and applicator device according to claim 1, in which the deformation and/or displacement distance of at least a portion of the membrane is lying in the range 5 mm to 15 mm.

25. A packaging and applicator device according to claim 1, the membrane being made of a compressible material.

26. A packaging and applicator device according to claim 1, the membrane being made of an elastomer.

27. A packaging and applicator device according to claim 1, including an interrupter system for interrupting communication between the reservoir and the dispenser orifice(s).

28. A packaging and applicator device according to claim 1, the section occupied by the dispenser orifice(s) being less than 75% of the area of the membrane that is covered by the flocking.

29. A packaging and applicator device according to claim 1, in which, in cross-section, the dispenser orifice(s) present (s) a greatest dimension that is less than or equal to 2 mm.

30. A packaging and applicator device according to claim 1, in which, in cross-section, the dispenser orifice(s) present (s) a greatest dimension that is lying in the range 0.4 mm to 1.8 mm.

31. A packaging and applicator device according to claim 1, in which, in cross-section, the dispenser orifice(s) present (s) a greatest dimension that is lying in the range 0.8 mm to 1.5 mm.

32. A packaging and applicator device according to claim 1, the dispenser orifice(s) being permanently open.

33. A packaging and applicator device according to claim 1, the dispenser orifice(s) being closed at rest, and opening under the pressure of the composition.

34. A packaging and applicator device according to claim 1, in which the surface covered by the flocking has an area that is greater than or equal to 175 $mm^2$.

35. A packaging and applicator device according to claim 1, the membrane including at least one portion in relief for massaging or treating the hair.

36. A packaging and applicator device according to claim 1, the dispenser orifice(s) being located at the center of the membrane.

37. A packaging and applicator device according to claim 1, the membrane including a rim that is fastened by clamping between the reservoir and the support.

38. A packaging and applicator device according to claim 1, the device including a closure cap that covers the membrane in the closed configuration of the device.

39. A packaging and applicator device according to claim 38, the cap including a lip that bears against the membrane along a line surrounding the dispenser orifice(s).

* * * * *